United States Patent [19]

Tanaka et al.

[11] Patent Number: 4,572,049

[45] Date of Patent: Feb. 25, 1986

[54] ELECTRIC GUITAR PROVIDED WITH TREMOLO UNIT

[75] Inventors: Yuji Tanaka, Akishima; Hideo Matsumoto, Shizuoka, both of Japan

[73] Assignee: Tokai Gakki Co., Ltd., Japan

[21] Appl. No.: 477,023

[22] Filed: Mar. 21, 1983

[30] Foreign Application Priority Data

Dec. 31, 1982 [JP] Japan ..... 57-198444

[51] Int. Cl.[4] ..... B10D 3/00

[52] U.S. Cl. ..... 84/313; 84/297 R; 84/298; 84/314 N

[58] Field of Search ..... 84/214, 297 R, 304–305, 84/313, 314 N

[56] References Cited

U.S. PATENT DOCUMENTS

| | | | |
|---|---|---|---|
| 550,268 | 11/1895 | Hafer et al. | 84/214 |
| 673,149 | 4/1901 | White | 84/305 |
| 2,741,146 | 4/1956 | Fender | 84/313 |
| 3,407,696 | 10/1968 | Smith et al. | 84/297 R |
| 4,171,661 | 10/1979 | Rose | 84/313 |
| 4,248,127 | 2/1981 | Lieber | 84/314 N |
| 4,457,201 | 7/1984 | Storey | 84/313 |
| 4,475,432 | 10/1984 | Stroh | 84/314 N |
| 4,497,236 | 2/1985 | Rose | 84/298 |

*Primary Examiner*—Lawrence R. Franklin
*Attorney, Agent, or Firm*—Darby & Darby

[57] ABSTRACT

There is provided an electric guitar including a tremolo unit and first and second string fixing devices. The first string fixing device is adapted to be mounted on the head of the guitar and includes a base and a fixing member for pressing a group of strings onto the surface of the base. The tremolo unit includes a tremolo block rockingly supported by the body of the guitar and having a plurality of through-holes for receiving therein the ends of the strings. The second string fixing device includes a base section integral with the tremolo block and slidingly supporting a plurality of bridges each carrying the corresponding one of the strings and adapted to be moved to adjust tensions developed in respective strings. The second string fixing device further includes means for fixing the strings at the intermediate portions thereof.

3 Claims, 9 Drawing Figures

ELECTRIC GUITAR PROVIDED WITH TREMOLO UNIT

BACKGROUND OF THE INVENTION

1. Field of the Invention:

This invention relates to an electric guitar provided with a tremolo unit, and particularly to an improvement in the string fixing devices, respectively, mounted on the head of the guitar and assembled with the tremolo unit.

2. Prior Art:

When the arm or neck of a conventional electric guitar provided with a tremolo unit is slightly bent to actuate the tremolo unit, each string is temporarily loosened and vibrated under the action of oscillatory rocking movement of the tremolo unit to generate a tremolo sound. During this tremolo playing operation, each string slides on a nut mounted on the head of the guitar and also on a corresponding bridge assembled with the tremolo unit so that the tension developed in the string is changed. Particularly, the tension between the nut and the peg is decreased and the tension between the bridge and the string fixing means is also decreased, resulting in dislocation of the string. The once dislocated string is not restored precisely to the original tuned position even when the arm of the guitar is freed from the bending force to be in the original straight condition, leading to aberration in tuning of the string.

In order to prevent the tension developed in each string, particularly at the portion extending from the peg to the nut and at the portion extending from the bridge to the string fixing means, from being decreased, a proposal has been made to mount a string fixing device 1 shown in FIG. 8 on one end of the neck of the guitar and to assemble another string fixing device 6 shown in FIG. 9 with the tremolo unit.

The prior art string fixing device 1 shown in FIG. 8 is mounted on one end of the neck of the electric guitar in lieu of the conventional nut for carrying the strings. However, the string fixing device 1 has a base 2 which is thicker than the thickness or height of the conventional nut. Thus, the end of the neck 4 of the guitar must be partially cut away to accommodate the string fixing device 1, which weakens the boundary portion between the neck 4 and the head 13. Another disadvantage of this prior art construction resides in that a separate string holder member 5 must be mounted on the end of the head 13 adjacent to the string fixing device 1 for guiding the string 3 to the peg mounted at the distal end of the head 13. In addition to a complicated operation required for assembling the string fixing device 1 and the separate string holder member 5, a cumbersome operation is required to pass each string through the string fixing device 1 and the string holder member 5. Furthermore, since the known string fixing device 1 is made of a metal, the timbre of the sound generated from the guitar is changed to an unpleasant metallic sound.

The prior art string fixing device 6 shown in FIG. 9 is assembled with a tremolo unit 7. As shown, an eyelet or ring at one end of a commercially available string 3 is cut off, and the end bared of eyelet is pressed on the back of a bridge 9 by means of a fixing screw 8. When a composite string composed of a core string and a covering coil string is used and the eyelet at one end of the composite string is cut off to be fitted by the string fixing device 6, the covering coil string tends to get loose. A more serious disadvantage of the prior art device 6 is that the string is fixed on the back side of the bridge 9 with no play. As a result, the string 3 is repeatedly bent at a certain point on the bridge 9, resulting in breakdown of the string 3 at the point occurred too quickly.

OBJECTS AND SUMMARY OF THE INVENTION

It is, therefore, a primary object of this invention to overcome the aforementioned disadvantages of the prior art device.

Another object of this invention is to provide an electric guitar having a tremolo unit and a string fixing device mounted on the head of the guitar rather than being mounted on the end of the neck of the guitar.

A further object of this invention is to provide an electric guitar having a tremolo unit and a string fixing device including a base having an upper surface and a fixing member for pressing strings onto the upper surface of the base.

A still further object of this invention is to provide an electric guitar having a tremolo unit and a string fixing device integral with the tremolo unit.

Other objects of this invention will become apparent from the following description of the invention.

The electric guitar according to this invention comprises a plurality of strings, a head having a nut for carrying thereon said strings and a first string fixing device mounted adjacent to said nut, and a body provided with a tremolo unit and a second string fixing device, said first string fixing device including a base fixedly secured to said head and a fixing member for pressing said strings onto the surface of said base, said tremolo unit including a tremolo block rockingly mounted on said body and having a plurality of through-holes for receiving therein the ends of said strings, said second string fixing device including a base section formed integrally with said tremolo block and slidingly supporting a plurality of bridges each carrying thereon the corresponding one of said strings, and said second string fixing device further including means for fixing said string.

According to a preferred embodiment of this invention, said means for fixing said strings comprises a base section having a plurality of threaded holes each communicating with the corresponding one of said through-holes of said tremolo block, and a plurality of fixing screws received in said threaded holes for pressing said strings onto the inner walls of said through-holes of said tremolo block.

DESCRIPTION OF THE DRAWINGS

The invention will become more readily apparent from the following description of a preferred embodiment thereof shown, by way of example, in the accompanying drawings, wherein.

DESCRIPTION OF A PREFERRED EMBODIMENT

A preferred embodiment of this invention will now be described with reference to FIGS. 1 to 7.

Figure 1:
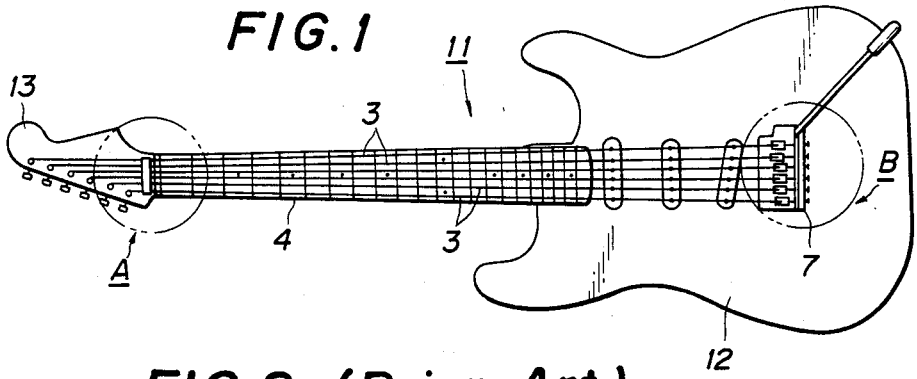
FIG. 1 is a front view of an electric guitar according to this invention.
Figure 8:
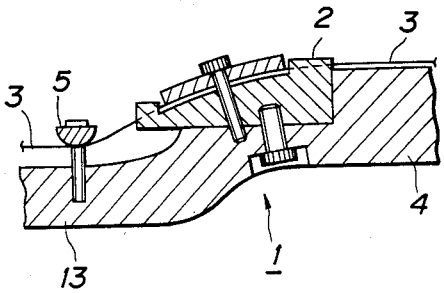
FIG. 8 (Prior Art)
FIG. 8 is an enlarged sectional view showing the structure of a prior art string fixing device mounted on the neck of a conventional guitar.
Figure 9:
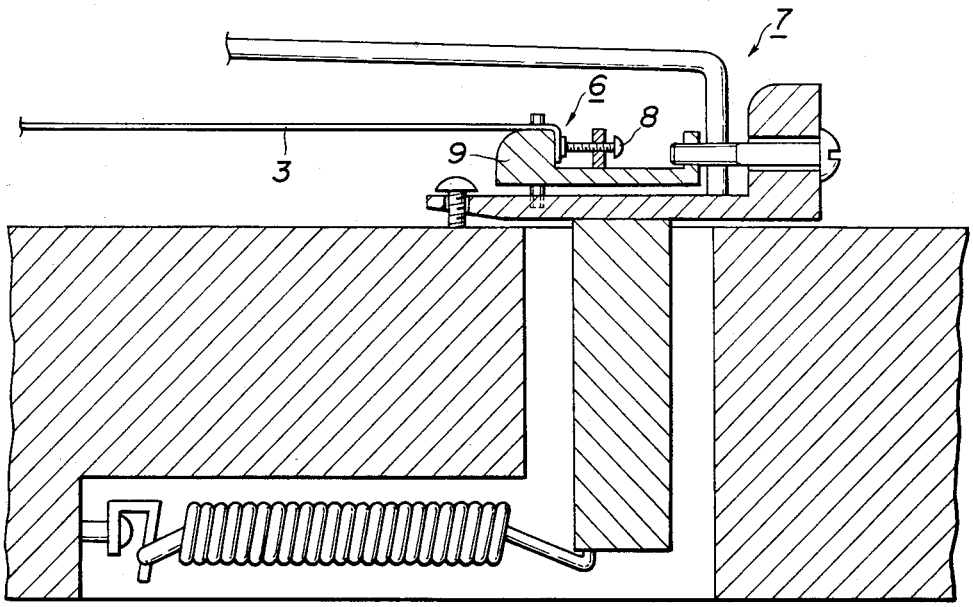
FIG. 9 (Prior Art)
FIG. 9 is an enlarged sectional view showing the structure of a prior art string fixing device assembled with a tremolo unit.

Firstly referring to FIG. 1, an electric guitar 11 comprises a body 12, a neck or arm 4 projecting from the body 12, a head 13 connected to the fore end of the neck 4, and strings 3 extending from the upper sound board of the body 12 above the neck 4 to the head 13. A tremolo unit 7 is mounted to the body 12, and has a string fixing device B. Another string fixing device A is mounted on the surface of the head 13.

Figure 2:
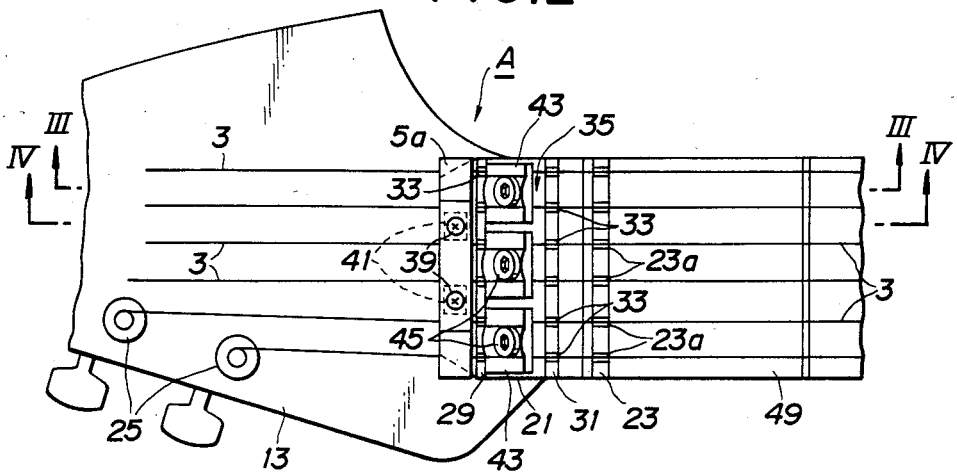
FIG. 2 is an enlarged view showing a string fixing device mounted on the head of the guitar shown in FIG. 1.
Figure 3:
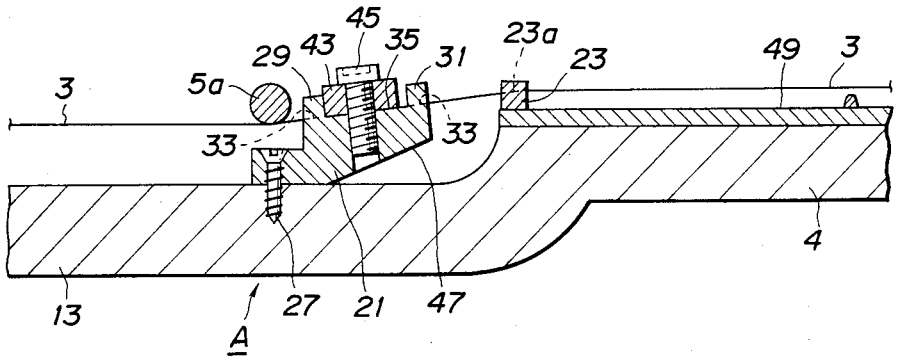
FIG. 3 is a sectional view taken along line III—III of FIG. 2.
Figure 4:
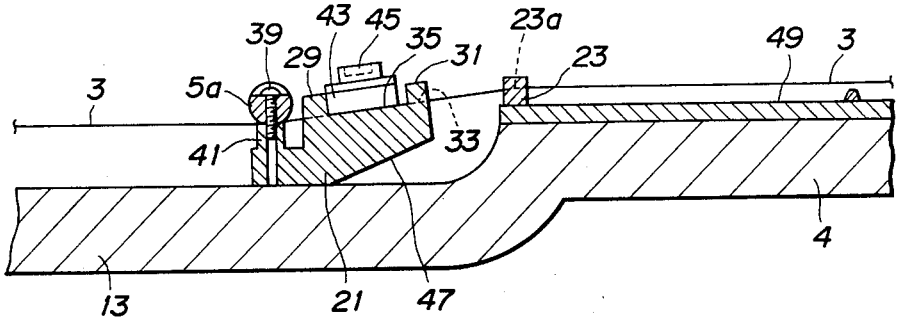
FIG. 4 is a sectional view taken along line IV—IV of FIG. 2.

Now referring to FIGS. 2 to 4, the string fixing device A mounted on the head 13 will be described in detail.

The string fixing device A has a base 21 which is mounted on the surface of the head 13 and disposed between peg means 25 and a nut 23 carrying thereon six strings 3. In general, the guitar 11 has six pegs 25, only two of them being shown in FIG. 2, and the ends of the six strings 3 are adjustably wound around them. The base 21 is fixed to the head 13 by means of screws 27, and has a sectional contour, as best shown in FIGS. 2 and 3, ascending toward the end of the neck 4. A fore land 29 and an aft land 31 are integrally formed on and rising from the surface of the base 21 to define therebetween a concave surface 35 on which string 3 rests. Since the concave surface 35 ascends in the direction toward the nut 23 or descends in the direction toward the pegs 25, the strings 3 extending from the nut 23 to the pegs 25 can be closely and snugly pressed onto the surface 35. The fore and aft lands 29 and 31 are formed with grooves 33 through which strings 3 pass. A string fixing member 5*a* is fixedly secured to the base 21 by means of screws 39 threaded into pillars 41 integrally protruding from the base 21, whereby the strings 3 are pressed downward to engage closely with the concave surface 35. In the illustrated embodiment, three string fixing pieces 43 are provided, each for pressing two strings onto the concave surface 35, and fixedly secured to the base 21 by means of screws 45. A wedge-shaped gap is formed between the slanting bottom face 47 of the base 21 and the upper surface of the head 13. A finger board 49 is applied on the surface of the neck 4.

Figure 5:
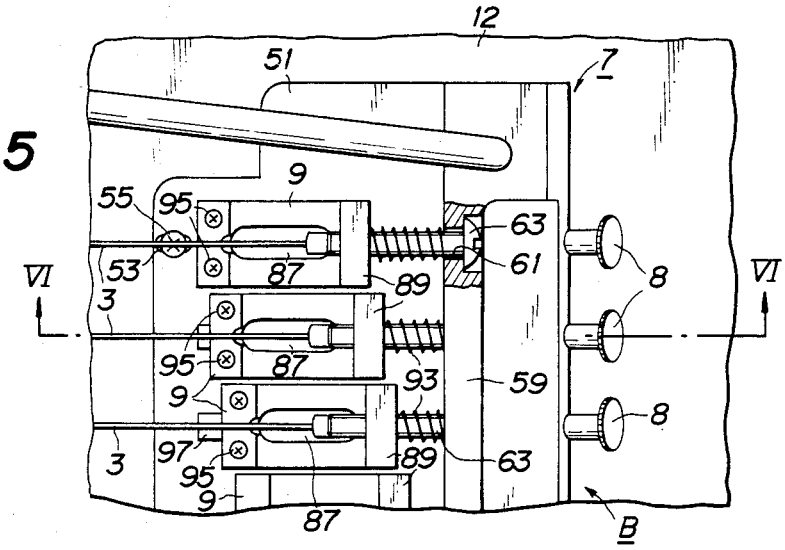
FIG. 5 is an enlarged view, partly in section, showing another string fixing device assembled with the tremolo unit shown in FIG. 1.

The string fixing device B integrally assembled with the tremolo unit 7 will be described with reference to FIGS. 5 to 7.

The tremolo unit 7 has a base section 51 of generally rectangular plate shape. Retaining holes 53 are formed at both corners of the base section 51, and retainer studs 55 are loosely inserted through the retaining holes 53 and have lower ends threaded into the sound board of the body 12. The upper ends or heads of the studs 55 are expanded to prevent the studs from getting out of the retaining holes 53. The upper end portion of each retaining hole 53 is cut-off by spot facing, as best shown in FIG. 6, to form an elongated and stepped recess which extends generally parallel to the passing direction of the strings 3. The peripheral edge of the elongated openings of the stepped recess are expanded slightly and arcuated at the longitudinal end corner portions, although not clearly illustrated in FIG. 5, to allow portions of the heads of the studs 55 to come into the stepped recess when the tremolo unit 7 including the base section 51 is rocking during the tremolo playing operation.

Figure 6:
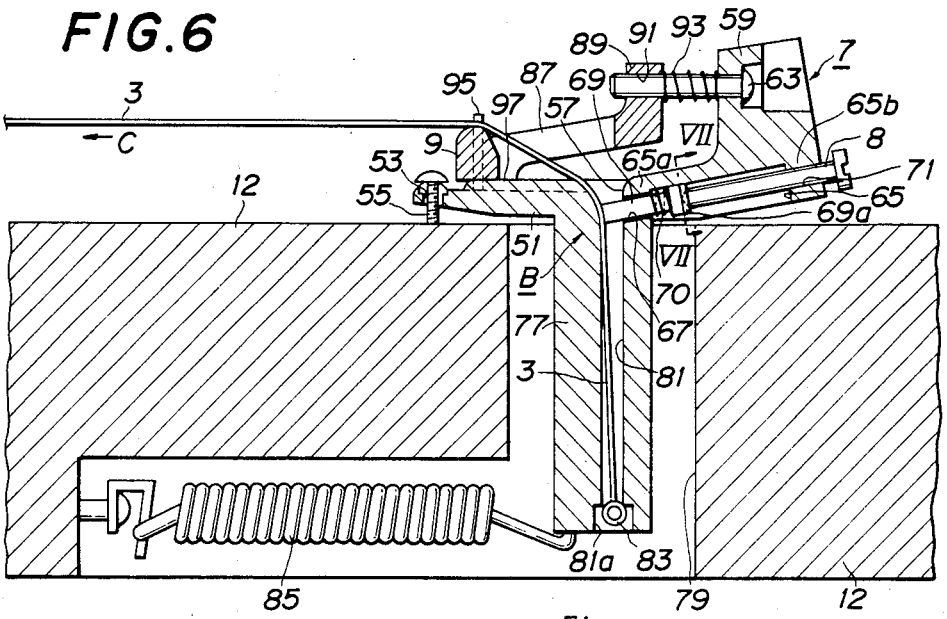
FIG. 6 is a sectional view taken along line VI—VI of FIG. 5.
Figure 7:
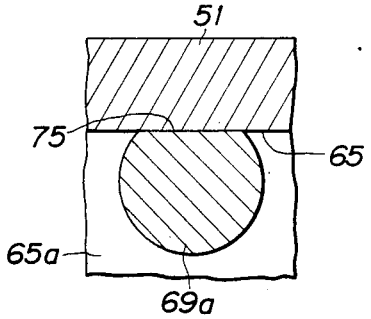
FIG. 7 is a sectional view taken along line VII—VII of FIG. 6.

Now referring to FIG. 6, reference numeral 57 designates one of through-holes through which a string 3 passes. The tremolo unit 7 has an upper rising edge 59 rising from the aft end portion of the base section 51. Six horizontal bores 61 are pierced through the rising edge 59 at the positions corresponding to the spots at which six strings are mounted. An adjust screw 63 is loosely inserted through each bore 61 for moving a bridge 9, the details of which will be described hereinafter, to control the octave pitch of each string 3.

Further referring to FIG. 6, a recess 65 is formed on the bottom of the aft section of the tremolo unit 7 and defined by a front wall 65*a* and an aft wall 65*b*. Six holes 67 having smooth surfaces are pierced through the front wall 65*a* and open onto the corresponding through-holes 57. Otherwise, each of the holes 67 may open onto corresponding one of through-holes 81 formed through a leg section of the tremolo unit 7, the leg section being referred to as a tremolo block 77 and described in detail hereinafter. A string pressing rod 69 is slidingly inserted into each hole 67 and biased by a spring 70. On the other hand, six threaded holes 71 extend through the aft wall 65*b* generally coaxially with the corresponding holes 67 of the front wall 65*a*. A string fixing screw 8 is adjustably threaded into and through each of the threaded holes 71 to push the surface of a head 69*a* of the aforementioned string pressing rod 69. The head 69*a* of the rod 69 has a generally disk-like contour with a portion cut away, as shown in FIG. 7, to form a flat edge 75 which engages with the bottom surface of the recess 65, so that the string pressing rod 69 is not rotated even when the screw 8 is rotated to control the fixing pressure applied on each string 3. With this construction, each string 3 is prevented from being damaged by the abutting end face of a rotating adjust screw. However, within the broad scope of this invention, the string pressing rod 69 may be dispensed with and each string may be pressed directly by the fore end face of a longer screw 8 extending through the holes 71 and 67 to protrude beyond the aft wall of the through-hole 57 or 81.

The leg section of the tremolo unit 7 defines a tremolo block 77 which is integral with the base section 51 and suspended downwards therefrom. The tremolo block 77 is loosely inserted in a slot 79 formed on the upper sound board of the body 12, and has through-holes 81 extending in the longitudinal direction of the leg section for receiving the strings 3. Each of the through-holes 81 communicates with the corresponding through-hole 57 formed in the base section 51 to define a continuous through-hole. The lower end of each through-hole 81 is enlarged to define a portion 81*a* having a larger diameter, so that an eyelet or ring 83 provided at one end of a commercially available string 3 is received and retained in the enlarged portion 81*a* as will be apparent from FIG. 6.

One or a plurality of tension springs 85 is housed in an appropriate slot formed on the bottom surface of the sound board, and has one end secured to the inner wall of the slot and the other end connected to the lower end portion of the tremolo block 77. The lower end of the tremolo block is normally pulled by the spring 85 so that the tremolo unit 7 is normally retained at the position, as shown in FIG. 6, at which the upper surface of the base section abuts against the lower faces of the heads of the studs 55, other than the time when the user desires to generate tremolo sounds.

A desired number, generally six, of bridges 9 are disposed on the upper surface of the base section 51. Each of the bridges 9 has a through-hole 87 at the substantial center thereof. Each string 3 passing through the through-hole 81 of the tremolo block 77 and through the through-hole 57 of the base section 51, further passes through the through-hole 87 and extends toward the neck 4, as shown by the arrow C in FIG. 6. Reference numeral 89 designates a projecting lug portion rising at the aft edge of each bridge 9. The projecting lug portion 89 has a threaded through-hole 91 into which the end of the adjust screw 63 is threaded. A compression spring 93 is fitted on the portion of each adjust screw extending from the front wall of the rising edge 59 to the rear wall of the projecting lug portion 89 of each bridge 9. Each bridge 9 can be moved in the fore and aft directions by rotating the adjust screw 63 to effect tuning of each string.

In the illustrated embodiment, two screws 95 are fitted to each one of the bridges 9 to adjust the height of the upper surface of the bridge 9 thereby to adjust the vertical level of the string 3.

Reference numeral 97 designates a slide guide projecting from the upper surface of the base section 51 for slidingly supporting each bridge 9. The slide guide 97 is of generally rectangular contour and extends between the two screws 95 for adjusting the height of the bridge 9. When the octave pitch adjusting screw 63 is rotated, the bridge is allowed to slide on the upper surface of the slide guide 97.

The operation of the illustrated embodiment of this invention will now be described.

In order to tightly stretch each string 3 on the electric guitar 11 and to fix the string 3 by the string fixing devices A and B, the string 3 is passed through the through-hole 81 of the tremolo block 77, the through-hole 57 of the base section 51 and the through-hole 87 of the bridge 9, and then allowed to extend over the neck 4. At the fore end of the neck 4, the string 3 is received in a groove 23*a* of the nut 23. Then, the string 3 is passed to the string fixing device A secured at the aft end of the head 13, where it passes through the groove 33 of the aft land 31, over the concave surface 35 of the base 21, through the groove 33 of the fore land 29 and beneath the string fixing member 5*a*, in this order. Then, the string 3 is wound around each peg 25 to be tightened thereby. After completing the tuning operation of all strings 3, respective screws 45 are rotated to tightly clamp the strings 3 between respective string fixing pieces 43 and the concave surface 35. On the other hand, by means of the string fixing device B assembled with the tremolo unit 7, each string 3 is fixed within the through-hole 57 of the base section 51 by the string pressing rod 69 by screwing up the string fixing screw 8.

In the electric guitar according to this invention, the string fixing device is mounted on the end surface of the head rather than being embedded in the neck, and includes a base adapted to be placed on and fixedly secured to the surface of the head and a fixing member for pressing the strings passing over the upper surface of the base. Accordingly, the string fixing device can be easily mounted on the head by an amateur user. Moreover, since the end of the neck is not necessarily cut away to form a notch for accommodating the string fixing device otherwise necessitated when the prior art device is used, the boundary portion between the neck and the head is not weakened, which overcomes the disadvantage caused by the mounting operation of the prior art string fixing device. Furthermore, since the strings are fixed by the parts which are separately fabricated from any desired material, the strings can be locked by the parts made of pertinent materials for generating sounds of good quality.

On the other hand, the string fixing device assembled with the tremolo unit comprises a base section integral with a tremolo block which protrudes from the downside of the base section and has a desired number of through-holes receiving therein strings, and string fixing means for pressing intermediate portions of respective strings. By the use of the string fixing device integral with the tremolo unit and having the aforementioned construction, according to this invention, it is not necessary to remove the eyelet or ring provided at one end of each string as it is in some conventional devices, thus avoiding the disadvantageous risk that the covering coil string may be stripped off or bared from the core string of a composite string. The most important advantage attained by the use of the string fixing device according to this invention is that any portion of each string is not bent repeatedly at one spot on the string so that the strings will not wear prematurely.

Although the invention has been described by referring to a preferred embodiment thereof, it should be appreciated that a variety of modifications and alternations may be made without departing from the spirit of the invention. Accordingly, the foregoing description is to be construed as illustrative only, rather than limiting. This invention is limited only by the scope of the following claims.

What is claimed is:

1. A combination tremolo unit and string securing means for a guitar, which comprises:

a base plate rockingly mounted to the body of the guitar and having openings formed therein to receive the strings of the guitar, the base plate having an upper surface, and further having retaining holes formed therein, and retaining studs received by the retaining holes, the retaining studs having expanded head portions, the retaining holes being formed as elongated and stepped recesses which extend generally parallel to the passing direction of the strings to allow the base plate to rock relative to the guitar body;

a plurality of bridges slidably mounted to the upper surface of the base plate, the number of bridges corresponding to the number of guitar strings and each bridge supporting a corresponding string, each of the bridges having a through-hole formed substantially centrally therein to allow a corresponding guitar string to pass therethrough, each of the bridges including a projecting lug portion rising at an edge thereof, the projecting lug portion having a threaded through-hole formed therein, each of the bridges further including an adjust screw, the adjust screw being threadingly received by the through-hole formed in the lug portion, and a compression spring encirclingly disposed about the adjust screw;

an upper rising edge portion projecting upwardly from the upper surface of the base plate in proximity to each of the bridges, the upper rising edge portion having formed therein a plurality of bores positioned in alignment with the bridges, each of the bores being dimensioned to loosely receive a corresponding adjust screw, the compression springs being interposed between the bridges and the upper rising edge portion to provide bias to the bridges and cause the same to move upon rotation of the adjust screws, the upper rising edge portion further including a bottom surface, a front wall and an aft wall projecting from the bottom surface, and a recess formed in the bottom surface between the front wall and the aft wall, the front wall having a plurality of holes formed therethrough, and the aft wall having a plurality of holes formed therethrough and generally coaxially positioned with corresponding holes formed in the front wall;

a tremolo block mounted to the underside of the base plate and suspended downwardly therefrom, the tremolo block having through-holes formed therein and extending longitudinally therethrough and communicating with corresponding openings formed in the base plate to receive the strings of the guitar, the tremolo block including a bottom end portion which defines an enlarged opening for each of the through-holes for receiving and restraining eyelets attached to the ends of the guitar strings; and means for fixing the strings to the tremolo unit, the string fixing means cooperating with a surface of the tremolo block and exerting a holding force on the strings to wedge the strings between the block and the fixing means, the string fixing means including a plurality of fixing screws, each of which extends through a corresponding hole formed in the aft wall of the upper rising edge portion and corresponds to a respective guitar string, a plurality of string pressing rods, each of which is interposed between a corresponding fixing screw and guitar string, each of the string pressing rods having a head of generally disc-like contour with a portion cut away to form a flat peripheral edge, the flat peripheral edge engaging a conforming face of the base plate to prevent the pressing rods from rotating, and a plurality of springs, each of which is interposed between the head of a corresponding pressing rod and the front wall to provide bias to the rod in a direction away from the guitar strings.

2. A combination tremolo unit and string securing means for a guitar as defined by claim 1, wherein the tremolo block further includes inner walls which at least partially define the through-holes formed in the block, the fixing screws including ends for pressing the guitar strings against the inner walls.

3. A combination tremolo unit and string securing means for a guitar as defined by claim 1, which further includes means for adjusting the height of each bridge of the plurality of bridges relative to the upper surface of the base plate.

* * * * *